US006250890B1

(12) United States Patent
Popov

(10) Patent No.: US 6,250,890 B1
(45) Date of Patent: Jun. 26, 2001

(54) LIQUID-GAS JET APPARATUS

(76) Inventor: Serguei A. Popov, 4615 Post Oak Pl., Suite 140, Houston, TX (US) 77027

( * ) Notice: Subject to any disclaimer, the term of this patent is extended or adjusted under 35 U.S.C. 154(b) by 0 days.

(21) Appl. No.: 09/319,682

(22) PCT Filed: Oct. 12, 1998

(86) PCT No.: PCT/IB98/01582

§ 371 Date: Jun. 9, 1999

§ 102(e) Date: Jun. 9, 1999

(87) PCT Pub. No.: WO99/19632

PCT Pub. Date: Apr. 22, 1999

(30) Foreign Application Priority Data

Oct. 14, 1997 (RU) ..... 97116820

(51) Int. Cl.[7] ..... F04F 5/36
(52) U.S. Cl. ..... 417/195; 417/54
(58) Field of Search ..... 417/196, 198, 417/51, 195, 54, 179; 623/3, 1

(56) References Cited

U.S. PATENT DOCUMENTS

| | | | | |
|---|---|---|---|---|
| 2,382,391 | | 8/1945 | Berman . | |
| 2,632,597 | | 3/1953 | Boeckeler . | |
| 3,667,069 | * | 6/1972 | Blackshear et al. | 623/3.1 |
| 4,274,812 | * | 6/1981 | Elvidge et al. | 417/179 |
| 4,881,875 | * | 11/1989 | Adkins | 417/54 |
| 5,074,759 | * | 12/1991 | Cossairt | 417/198 |

FOREIGN PATENT DOCUMENTS

| | | |
|---|---|---|
| 51229 | 4/1890 | (DE) . |
| 393478 | 12/1973 | (SU) . |
| 1291729 | 2/1987 | (SU) . |
| 1302031 | 4/1987 | (SU) . |

* cited by examiner

*Primary Examiner*—Teresa Walberg
*Assistant Examiner*—Quang Van
(74) *Attorney, Agent, or Firm*—Mark A. Oathout

(57) ABSTRACT

The invention pertains to the field of jet technology and essentially relates to a nozzle for discharge of an ejecting liquid medium. The nozzle constitutes a collection of shaped channels. The central channel is coaxial to the mixing chamber, the other channels are uniformly allocated around and encircle the central channel. The total surface area of the outlet cross-section of the nozzle is determined from the following formula: $S=S_{\mu}[1+\sqrt[4]{(S_{KC}/S_{\mu})^3}]$, where S—the total cross-sectional area of the outlet section of the nozzle; $S_{\mu}$—cross-sectional area of the outlet section of the nozzle's central channel; $S_{KC}$—cross-sectional area of the minimal section of the mixing chamber. A liquid-gas jet apparatus with the above-mentioned characteristics has an improved operational reliability.

6 Claims, 1 Drawing Sheet

LIQUID-GAS JET APPARATUS

This invention pertains to the field of jet technology, primarily to vacuum jet apparatuses for evacuation of vapor-gas mediums. Such jet apparatuses are applied in various industrial processes.

BACKGROUND

A vacuum jet apparatus is known, which comprises a nozzle for discharge of an active steam medium, a mixing chamber and a diffuser (see, for example, patent DE, 51229,).

This jet apparatus has a low efficiency factor and requires great energy consumption for production of the active steam.

The closest analogue of the apparatus described in the present invention is a liquid-gas jet apparatus, which comprises a nozzle for feed of an ejecting liquid medium and a mixing chamber (see, for example, U.S. Pat. No. 2,632, 597,).

The jet apparatus creates a rarefaction in the evacuated object using energy of the ejecting liquid medium and a rather compact self-contained device for evacuation of various vapor-gas mediums. But it is difficult and in some cases impossible to provide stable operation of this jet apparatus if the apparatus is designed for evacuation of large amounts of gases. This is related to the fact, that the scale effect reduces to zero the advantages of the apparatus as caused by the peculiarities in forming the ejecting medium's flow in its nozzle.

SUMMARY OF THE INVENTION

The technical problem to be solved by this invention is an increase of reliability of a liquid-gas jet apparatus by provision of a more steady flow of an ejecting liquid medium and reduction of energy losses during interaction of the ejecting medium with an evacuated (passive) medium.

The above mentioned problem is solved as follows: a nozzle of a liquid-gas jet apparatus, where the apparatus has a nozzle for feed of an ejecting liquid medium and a mixing chamber, includes a collection of shaped channels. The collection of channels comprises a central channel placed in alignment to the mixing chamber and a number of peripheral channels uniformly allocated around the central channel. The total surface area of the outlet cross-section of the nozzle is determined from the formula:

$$S=S_{\mu}[1+\sqrt[4]{(S_{KC}/S_{\mu})^{3}}],$$

where

S—the total cross-sectional area of the outlet section of the nozzle;

$S_{\mu}$—cross-sectional area of the outlet section of the nozzle's central channel;

$S_{KC}$—cross-sectional area of the minimum section of the mixing chamber.

The outlet cross-sections of the peripheral channels can lie in the plane of the outlet cross-section of the central channel, or they can be shifted in the counter-flow direction relative to the outlet cross-section of the central channel.

The peripheral channels can be positioned around the central channel in a circle, in which the diameter of this circle represents from about 0.05 to about 4.5 times that of the square root of the surface area of the outlet cross-section of the central channel. All of the channels of the nozzle can be convergent-cylindrical in the flow direction.

It was discovered that the introduced design of the nozzle for discharge of an ejecting liquid medium ensures more effective use of the energy of the ejecting liquid medium due to a reduction in energy losses during interaction between the ejecting and the evacuated mediums. Jets of the ejecting medium flowing from the peripheral channels provide the primary contact between the ejecting and evacuated mediums. The kinetic energy of the evacuated medium increases, via hit losses while the transfer of kinetic energy from the central jet of the ejecting medium to the evacuated medium are reduced. Additionally, availability of an ensemble of jets of the ejecting medium causes considerable expansion of a peripheral unstable area of the ejecting medium's flow. This promotes creation of a zone of gradual increase of the evacuated medium's kinetic energy. This is especially important in the case of evacuation of a vapor-gaseous medium, which contains rather big drops of condensate of the vapor phase as compared with the gas molecules. In this case a proper proportion between the cross-sectional areas of the central and peripheral channels of the nozzle and proper correlation between the surface areas of the outlet cross-section of the nozzle and the minimal cross-section of the mixing chamber are very important. It was discovered that the optimal correlation between the mentioned cross-sectional areas, which is described by the above calculation dependence, is valid for liquid-gas jet apparatuses with different rated characteristics. It is advisable that the $S_{KC}/S_{\mu}$ ratio vary from 10 to 78 and the $S_{KS}/S$ ratio vary from 2.4 to 7.93.

In some cases the relative spatial position of the outlet cross-sections of the central and peripheral channels has an influence on the apparatus' performance. The most common case is when the outlet cross-sections of the central and peripheral channels lie in the same plane. But in some cases there is a high content of easy condensable vapors in the evacuated medium and consequently there are many liquid drops in it. In such cases it is advisable to shift the outlet cross-sections of the peripheral channels in the counter-flow direction in order to prolong the time of contact of the ejecting and evacuated mediums and to accelerate the evacuated medium gradually with less losses for hit during its interaction with the ejecting medium.

The distance from the peripheral channels to the axis of the central channel is also important for optimal formation of the ejector flow. It was discovered that rational disposition of the peripheral channels, which excludes the reverse flow of the medium, is achieved by positioning of the peripheral channels uniformly in a circle around the central channel, where the diameter of this circle represents from about 0.05 to about 4.5 times that of the square root of the surface area of the outlet cross-section of the central channel. It is also advisable to make the nozzle's channels convergent-cylindrical in the flow direction.

So, the introduced design of a liquid-gas jet apparatus provides a solution to the stated technical problem—and thus, apparatuses of the introduced design exhibit an improved operational reliability.

DETAILED DESCRIPTION

Figure 1:
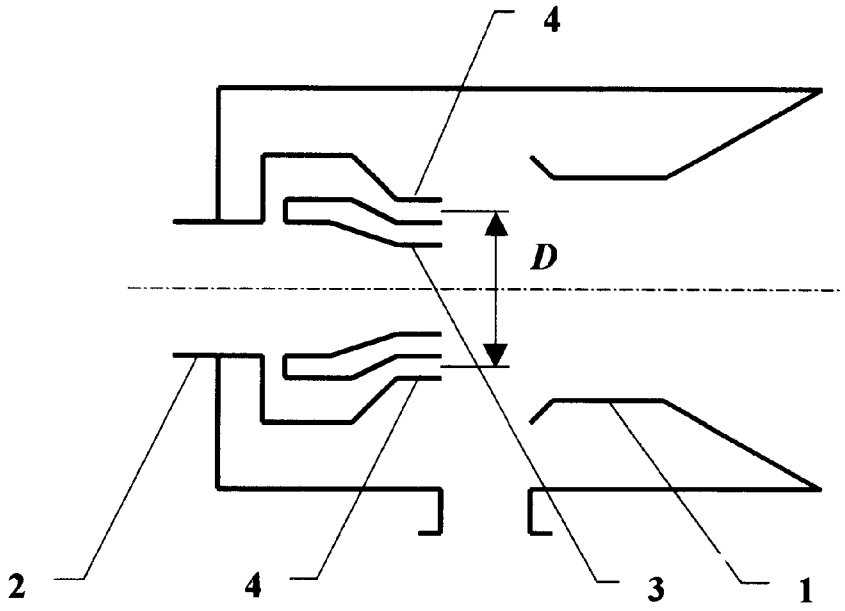
FIG. 1 shows a schematic diagram of one embodiment of the described liquid-gas jet apparatus.
Figure 2:
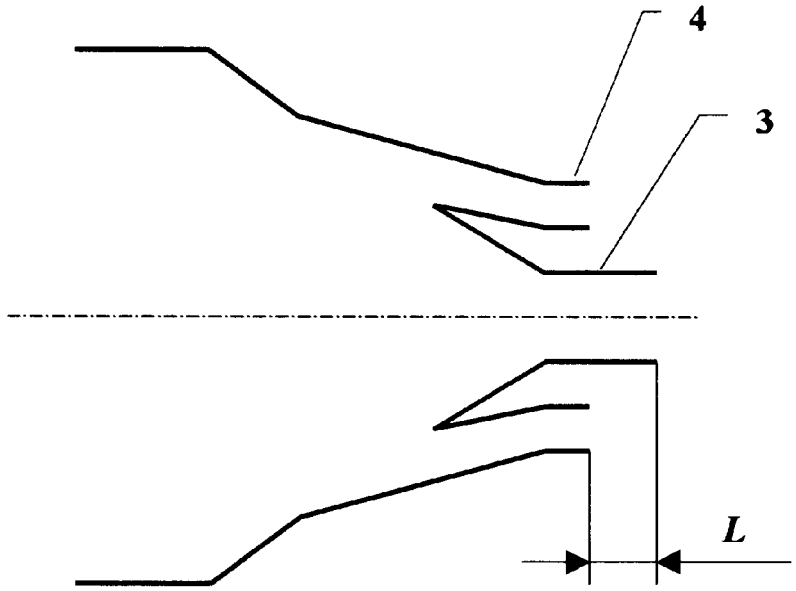
FIG. 2 shows a schematic diagram of another embodiment of the apparatus, wherein the peripheral channels are shifted in the counter-flow direction relative to the outlet cross-section of the central channel.

The liquid-gas jet apparatus comprises a mixing chamber 1 and a nozzle 2 for discharge of an ejecting liquid medium.

The nozzle 2 has a central channel 3 and peripheral channels 4. The total cross-sectional area (S) of the outlet section of the nozzle 2 is calculated as follows:

$$S=S_{\mu}[1+\sqrt[4]{(S_{KC}/S_{\mu})^{3}}],$$

where $S_{\mu}$—cross-sectional area of the outlet section of the nozzle's central channel 3;

$S_{KC}$—cross-sectional area of the minimum section of the mixing chamber 1.

The outlet cross-section of the central channel 3 can either lie in the plane of the outlet cross-sections of the peripheral channels 4, or the outlet cross-section of the peripheral channels 4 can be shifted in relation to the outlet cross-section of the central channel 3 in the counter-flow direction by the distance L, which is calculated as follows: $L=(0.56 \text{ to } 11.28)\sqrt{S_{\mu}}$.

The peripheral channels 4 can encircle the central channel 3, where diameter D of this circle represents from about 0.05 to about 4.5 times that of the square root of the surface area of the outlet cross-section of the central channel $S_{\mu}$, and the channels 3 and 4 of the nozzle 2 can be convergent-cylindrical (i.e. composed of a convergent section turning into a cylindrical section) in the flow direction.

The Liquid-gas jet apparatus operates as follows.

An ejecting liquid medium flows from the peripheral channels 4 and central channel 3 and entrains a gaseous or vapor-gaseous evacuated medium into the mixing chamber 1. As a result of mixing of the ejected and evacuated mediums a gas-liquid flow is formed and the transfer of a part of the kinetic energy of the ejected medium to the evacuated medium takes place. The gas-liquid medium from the mixing chamber 1 passes to its destination, for example into a separator (not shown), where the liquid ejected medium is separated from the compressed evacuated gas.

Industrial Applicability

The above described liquid-gas jet apparatus can be applied in many industries, especially in the petrochemical industry for vacuum refinement of an oil stock in rectifying vacuum columns.

What is claimed is:

1. A liquid-gas jet apparatus, including a nozzle for ejecting a liquid medium into a mixing chamber, wherein the nozzle for ejecting the liquid medium has a collection of shaped channels, one of said channels being the central channel and located in alignment to the mixing chamber, and a plurality of peripheral channels being positioned uniformly around the central channel, wherein the total cross sectional area of the outlet section of the nozzle for ejecting the liquid medium is determined from the formula:

$$S=S_{\mu}[1+\sqrt[4]{(S_{KC}/S_{\mu})^{3}}],$$

where

S is the total cross sectional area of the outlet section of the nozzle;

$S_{\mu}$ is the cross sectional area of the outlet section of the nozzle's central channel;

$S_{KC}$ is the cross sectional area of the minimum section of the mixing chamber.

2. The jet apparatus as claimed in claim 1, wherein the outlet section of the peripheral channels lies in the plane of the outlet section of the central channel.

3. The jet apparatus as claimed in claim 1, wherein the outlet sections of the peripheral channels are shifted in relation to the outlet section of the central channel in a counter-flow direction.

4. The jet apparatus as claimed in claim 1, wherein the peripheral channels encircle the central channel having a diameter from 0.05 to 4.5 times the square root of the outlet cross-sectional area of the central channel.

5. The jet apparatus as claimed in claim 4, wherein the channels of the nozzle for ejecting the liquid medium are convergent-cylindrical in the flow direction.

6. The jet apparatus as claimed in claim 1, wherein the channels of the nozzle for ejecting the liquid medium are convergent-cylindrical in the flow direction.

* * * * *